United States Patent [19]

Ogden et al.

[11] Patent Number: 4,871,077

[45] Date of Patent: Oct. 3, 1989

[54] TAMPER RESISTANT, TAMPER EVIDENT LEAK PROOF CONTAINER

[75] Inventors: Stanley D. Ogden, Clovis; William C. Dixon, Fresno, both of Calif.

[73] Assignee: Doxtech, Inc., Fresno, Calif.

[21] Appl. No.: 176,529

[22] Filed: Apr. 1, 1988

Related U.S. Application Data

[63] Continuation-in-part of Ser. No. 43,904, Apr. 27, 1987, Pat. No. 4,813,563.

[51] Int. Cl.[4] ..... B65D 39/00

[52] U.S. Cl. ..... 215/366; 215/307; 215/355; 220/254

[58] Field of Search ..... 215/366, 253, 355, 307, 215/250; 220/254, 265, 266

[56] References Cited

U.S. PATENT DOCUMENTS

| | | | |
|---|---|---|---|
| 3,348,719 | 10/1967 | Rausing et al. | 215/253 |
| 3,374,911 | 3/1968 | White | 215/366 |
| 3,567,061 | 3/1971 | Song | 220/270 |
| 3,898,046 | 8/1975 | Ikeda et al. | 215/355 X |
| 4,098,422 | 7/1978 | Slomski | 215/355 |
| 4,231,486 | 11/1980 | Bock | 215/355 |
| 4,399,920 | 8/1983 | Swartzbaugh et al. | 215/211 |
| 4,452,364 | 6/1984 | Kay | 215/253 |
| 4,461,391 | 7/1984 | Davis | 215/252 |
| 4,534,480 | 8/1985 | Santostasi et al. | 215/252 |
| 4,541,536 | 9/1985 | Davis et al. | 215/252 |
| 4,548,329 | 10/1985 | Curry | 215/252 X |
| 4,588,100 | 5/1986 | Itsubo et al. | 215/252 |
| 4,592,475 | 6/1986 | Hannon et al. | 215/252 |
| 4,592,476 | 6/1986 | Yasada | 215/252 |
| 4,597,500 | 7/1986 | Stubbs | 215/256 |
| 4,609,115 | 9/1986 | Moore et al. | 215/252 |
| 4,630,743 | 12/1986 | Wright | 215/253 X |

FOREIGN PATENT DOCUMENTS

| | | | |
|---|---|---|---|
| 1007350 | 2/1952 | France | 215/355 |
| 1131300 | 10/1956 | France | 215/355 |

*Primary Examiner*—Donald F. Norton
*Attorney, Agent, or Firm*—Philip A. Dalton

[57] ABSTRACT

A tamper resistant, tamper evident container is formed of a vial having a barb or hook formed inside the open upper end, a cap adapted for insertion into the vial having a mating hook formed about the lower edge, and sealing rings formed on the outer surface thereof for providing tamper-resistant, leak-proof sealing between the enclosure and the vial. The enclosure or cap also includes a spout which may extend inwardly into the enclosure or outwardly, away from the enclosure. In a preferred embodiment, the spout has an integral seal member defined at the top or bottom thereof by a circumferential parting line of reduced thickness for facilitating separation of the seal member from the spout. Removable or locking plugs may be used to seal the spout following opening thereof. Preferably, a liquid-proof identification label is used which is placed inside the vial prior to closure. This label may include temperature sensitive indicia which change colors at selected temperatures, for example, above and below the normal body temperature, for providing additional proof of non-tampered contents.

12 Claims, 6 Drawing Sheets

NAME
I.D.NO.
DATE
AGENT
MAXIMUM FILL
90ML
60ML
30ML
3OZ.
2OZ.
1OZ.

TAMPER RESISTANT, TAMPER EVIDENT LEAK PROOF CONTAINER

This is a continuation-in-part of our co-pending, commonly assigned U.S. patent application, Ser. No. 07/043,904, filed Apr. 27, 1987, now U.S. Pat. No. 4,813,563, issued Mar. 21, 1989.

BACKGROUND OF THE INVENTION

The present invention relates generally to the field of tamper resistant containers for storing and transporting liquids and solids, such as urine specimens and tablets. In particular, the present invention itself relates to a tamper resistant, tamper evident container for liquids and solids and to such a container which provides a high degree of security and integrity to the sample The need for, and problems in providing tamper proof containers for solids such as aspirin, prescription drugs and other pharmaceuticals and for tamper proof chain of custody containers for liquids such as urine samples are well known. Considering, first, pharmaceutical containers, one widely used type of protection against tampering or adulteration of the container contents involves affixing a metal or plastic seal over the mouth of the container, beneath the screw cap. While such seals can be removed or destroyed, in theory the removal or destruction would result in visible damage to the seal, which would warn the user of the possibility of tampering. However, in reality, it may be possible to remove the seal intact, for example, by degrading the adhesive but not the seal, with the result that the seal can be replaced without leaving evidence of the tampering. Also, it may be relatively easy to obtain or fashion a replacement seal. In short, the widely used tamper-evident seals may be circumvented.

Secondly, tamper resistant liquid containers typically consist of a sealable bag having an external identification label or a bottle or vial which has a screw cap and an external identification label. Physical security against tampering may be provided in several ways such as by ratchet-type lids. Evidence of tampering may be provided by an adhesive tape which is adhered over the cap and vial. However, it may be possible to remove the tape intact by degrading the adhesive Also, it may still be possible to fashion or obtain a replacement tape to replace the one removed. Furthermore, the identification label is susceptible to being removed and/or altered. As a consequence, it may be possible to simply alter the identifying indicia associated with a particular container or to interchange containers.

In short, conventional so-called tamper resistant containers suffer from disadvantages which include possible undetected removal of the "tamper-evident" seals, tampering of identification, and lack of certainty as to when the seal was actually supplied, and the lack of true physical security against tampering. In addition, providing leak proof containers and, in particular, the combination of resistance to tampering and resistance to leakage, is a very difficult task.

SUMMARY OF THE INVENTION

In view of the above discussion, it is one object of the present invention to provide components for a relockable container which is highly tamper resistant, highly tamper evident and leak proof.

In one aspect, the tamper resistant, tamper evident container of our invention comprises an open top cup of cylindrical or oval or other selected cross-section, having inwardly extending first lip means such as barb means formed about the upper inner surface thereof; a cover or enclosure comprising a sidewall of suitable cross-sectional size and configuration for sliding insertion into the open end of the cup and having outwardly extending second lip means such as hook means formed about the bottom outer surface of the sidewall thereof, the cover mounting an integral spout defining a potential opening; and a lockable plug. The plug comprises an enclosed sidewall of suitable cross-sectional configuration and size adapted for insertion into the spout, and has outwardly extending lip means such as barb mean formed about the bottom outer surface of the plug sidewall for locking engagement with the bottom outer surface of the spout. The bottom of the sidewall includes a plurality of generally axially extending slots for facilitating flexible insertion of the plug into the spout. The plug also includes a cap formed at the top of the plug and having a peripheral lip portion spaced approximately the length of the spout from the plug's barb means for engaging the spout to lock the hook of the inserted plug against the spout. Preferably, the cap portion of the plug is joined to the sidewall thereof along a peripheral parting line adapted for severing, thereby permitting removal of the cap from the spout.

Another plug may be inserted into the spout to relock the container. When this is done, the bottom portion of the previously inserted plug drops into the bottom of the cup, thus providing a positive, visible means of determining how many times the container has been opened and relocked.

Preferably, the container includes a liquid-resistant identification label of size and configuration for being placed inside the cup.

In another aspect, the cover includes a flexible annulus jointed integrally to and spaced laterally outwardly from the cover sidewall and having peripheral ribs formed in the outer surface thereof of size for sealing against the inside of the cup. Also, the plug may include peripheral rib sealing means formed in the outer surface of its sidewall thereof for sealing against the inside of the spout.

BRIEF DESCRIPTION OF THE DRAWINGS

The above and other aspects of our present invention are described in the drawings in which.

DETAILED DESCRIPTION

Figures 1, 2, 3:
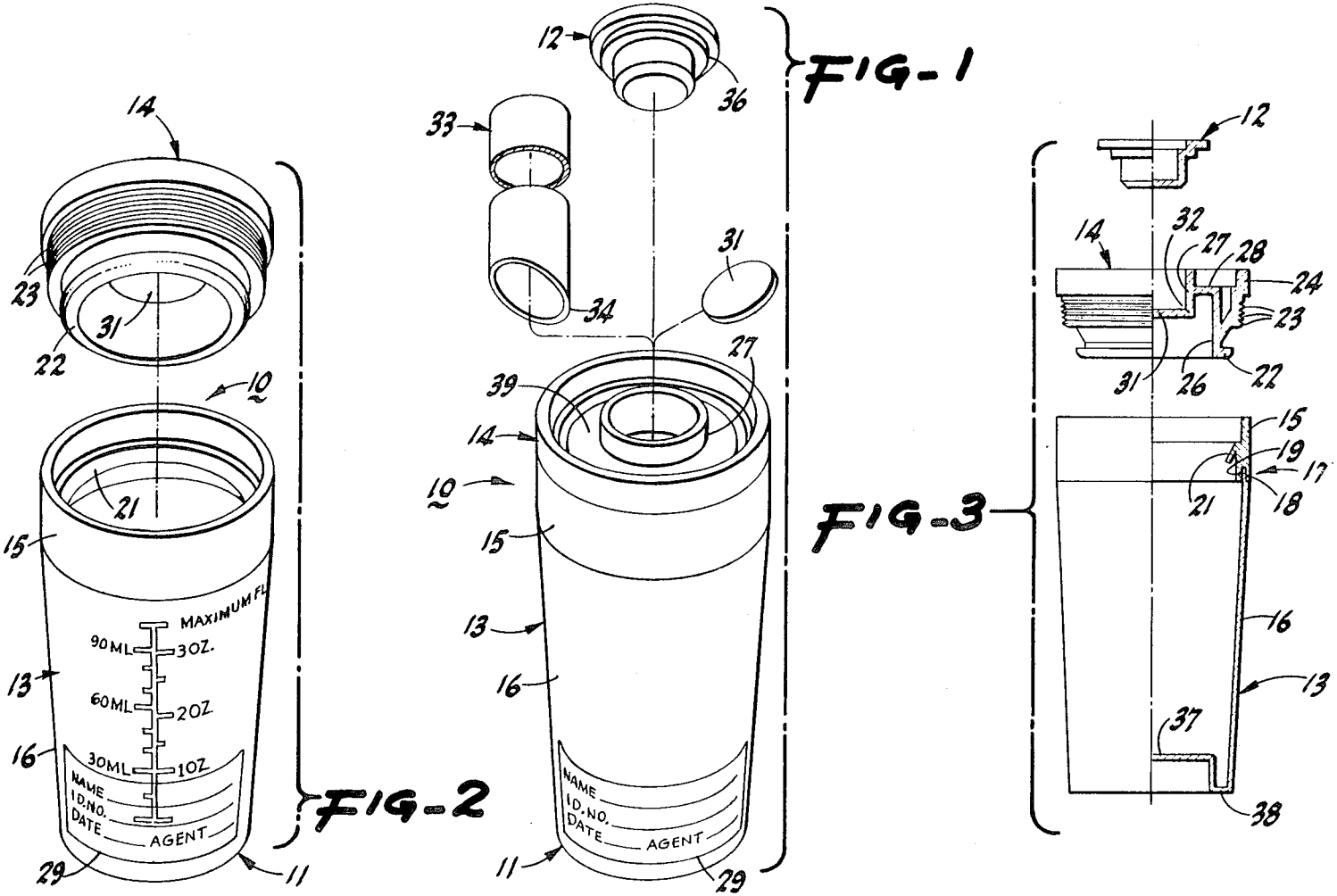
FIG. 1 is a perspective view of a presently preferred embodiment of our tamper resistant, tamper evident, leak proof container showing the relationship of the bottle, removable seal tab, seal tab removal tool, and plug.
FIG. 2 is an exploded perspective view of the bottle portion of the container of FIG. 1, showing the relationship of the locking cover or closure to the cup.
FIG. 3 is an exploded elevation view, partly in section, of the tamper proof container of FIG. 1.

A presently preferred embodiment of our tamper resistant, tamper evident container assembly 10 is shown in FIGS. 1-3. The locked, assembled container 10 comprises a cup or vial 13 and a locking cap or closure 14. In turn, the cup or vial 13 comprises lower bowl or cup 16 and locking ring 15. Inside the cup or vial 13 is a pre-marked identification label 29. The streamlined, hard container makes it difficult to grasp for tampering.

Referring further to FIGS. 1-3, typically, and as described further below, the above-described components can be injection molded from hard, clear plastic, metal, or other hard material.

For example, the bottom bowl 16 and locking ring 15 preferably are injection molded from hard, relatively rigid inflexible material such as transparent, colorless medium viscosity injection molding resin, e.g., butadiene-styrene or Lexan 141 ™ polycarbonate or equivalent. Butadiene-styrene and polycarbonate have approximate equivalent flexibility characteristics. Although polycarbonate is clearer and has somewhat better heat resistance, butadiene-styrene is believed to be cheaper and therefore might be preferred where cost is paramount. Lexan 141 ™ is available from General Electric Company, Pittsfield, Me., U.S.A.

Similarly, the locking closure 14 preferably is formed from hard, somewhat flexible material such as stabilized medical application-type low or high density polyethylene homopolymer which is natural in color (no color).

The above materials do not have "memory" so that, if punctured by a hypodermic needle or other sharp instrument, the resulting hole is visually evident and leaks. In addition, as mentioned, these materials are relatively hard and are configured in a straight smooth profile to resist tampering. The closure material and configuration are sufficiently flexible to provide the sealing and locking closure functions described at length below. Also, the closure and its associated lip means are chosen to be relatively flexible in comparison to the cooperating cup and its associated lip means to enable secure locking of the closure to the cup. If the materials were harder, they might simply preclude puncture rather than providing evidence of puncture, but would prevent puncture at the expense of possible loss of the liquid sealing function.

The container assembly 10, which is described above and at greater length below, is characterized by at least the following advantageous features: (1) ease of use and storage; (2) time security (i.e., assurance that the proper contents of the container were deposited at the proper time; and (3) tamper resistance; as well as (4) tamper evidence. Once the container 10 is used and the contents are deposited or inserted, and the enclosure inserted to seal the container, it is virtually impossible to tamper with or alter or replace the contents or the identification label inside the container without destroying the sealed container and/or leaving evidence of the attempt.

Referring further to FIGS. 1-3, to facilitate the injection molding process, the bottom bowl 16 and the ring 15 of the cylindrical vial or cup 13 are formed separately and then joined. As shown in particular in FIG. 3, this joint 17 comprises a mating tongue 18 and groove 19 formed in the top and bottom edges of the bottom bowl 16 and ring 15 (or vice versa). The container assembly 10 is permanently joined along the joint 17 by ultrasonic bonding or solvent welding, etc. In one present commercial embodiment, methylene chloride is applied to form a solvent-welded joint between the tongue 18 and groove 19, which as mentioned are formed of thermal plastic material such as polycarbonate or butadiene-styrene.

In use, the label 29 is filled out and placed inside the vial or cup assembly 13, the urine sample or other liquid, tablets, etc., are put into the vial or cup assembly 13, then closure 14 is inserted into the cup and is retained by two sealing joints. The first joint is formed by an interference-fit between circular barb 21 formed along the inner periphery of the cup's locking ring 15 and a mating circular hook 22 formed along the outer periphery of the bottom edge of the closure 14. The purposes of this joint are two-fold: primarily, to securely lock the inserted closure 14 to the vial 13, since the shape of the two parts allows a sliding fit in the direction of insertion only, while the interference between them prevents separation or removal except by damaging the container; and, secondarily, to provide a fluid/liquid seal. The second joint is provided by resilient sealing ribs 23-23, illustratively four in number, which are formed in the outer periphery of the closure 14 intermediate the top and bottom ends thereof. The functions of the rings 23-23 are, primarily, sealing and preventing fluid/liquid leakage between the vial 13 and the closure 14 and, second, aiding the joining function of the ratchet-type hook and barb joint 18-19.

Construction of the closure 14 is perhaps best shown in FIG. 3. Preferably, the rings 23-23 are formed in an annulus 24 which is formed integrally with inner annulus 26 and is spaced laterally outwardly from the inner annulus 26 by a joining web 30. The lower, inner annulus 26 incorporates circular hook 22 at the lower edge thereof. A cylindrical recessed spout 27 is connected by web 28 to the top of the annulus 26. Preferably, as mentioned previously, the closure 14 is formed of a hard, relatively rigid yet slightly resilient, non-memory plastic material such as high density polyethylene. As a consequence of the use of this material, and of the sealing ribs 23-23 and the hook 22 being formed in the laterally off-set annuli 24 and 26, the annulus. 26 and hook 22 deflect slightly during insertion of the closure 14 into the vial 13, allowing the hook 22 to thereby pass over the barb 21, and then lock under the barb 21. Also, the annulus 24 and sealing ribs 23-23 are deflected inwardly slightly during insertion and then spring back to securely compress the sealing ribs 23-23 against the inner surface of the locking ring 15 and provide the liquid-tight seal. The laterally offset relatively flexible rings or annuli 24 and 26 permit independent locking and sealing operation without one adversely affecting the other.

Access is gained to the interior of the cup 13 for analysis or other use of the contents via a removable circular sealing tab 31 which is formed at the bottom of spout 27. Referring primarily to FIG. 3, the tab 31 is defined by a circular parting line 32 of reduced thickness which is formed between the tab 31 and the vertical wall of the spout 27, that is, at the edge between the tab 31 and cylindrical wall spout 27.

Referring to FIG. 2, the seal 31 is removed using any pointed knife or sharp instrument or a special cutting tool 33 which has an angled cutting end 34. Preferably, the cutting end 34 corresponds in both size and configuration to the parting line 32. In use, the tool 33 is inserted into a spout 27, cutting end first, and is rotated and pushed against the seal 31 to separate the seal from the spout 21 along the parting line 32. The vial contents or a sample of the contents can then be poured from the spout, removed by pipette, etc., for analysis or use. After partial removal of the contents, the container is resealed by inserting a mating, friction fit removable plug 12 into the spout 27. As shown in FIG. 1, the plug 12 has an upper flange 36 which both facilitates sealing against the spout 27 and also facilitates gripping and removal of the plug.

Referring again to FIGS. 1 and 3, the lower bowl/-cup 16 has a recessed bottom 37 which is surrounded by a downwardly extending, generally circular, peripheral lip 38. The lip is sized to permit insertion into the recess 39, FIG. 1, in the top of the closure 14 of other containers and to provide a close fit against the circular lip or annuls 24, with the recess 37 clearing the top of the spout 27 and plug 12. This configuration permits stacking two or more containers, one on the other, for storage.

Figure 4:
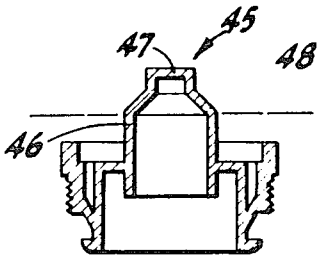
FIG. 4 is a cross-section of an alternative spool-type cup closure or cover.

FIG. 4 depicts one example of an alternative closure 45 that has an upwardly extending spout 46 which extends above the plane of the closure 14 to facilitate pouring and access to the contents of the container. An integral top seal 47 can be cut away, for example, along line 48 using a sharp instrument. Alternatively, a parting line may be provided around the circumference of the spout 46 or in the seal 47 (similar to the parting line used in the seal 32 in the recessed spout 27, FIG. 1) to facilitate removal of the seal 47. It should be noted that both the tab 31, FIG. 1, and the seal 47, FIG. 4, are easily removed with tools or cutting instruments but have sufficient integrity to otherwise provide a permanent, leak-proof, tamper-resistant, tamper-evident structure.

Figure 5:
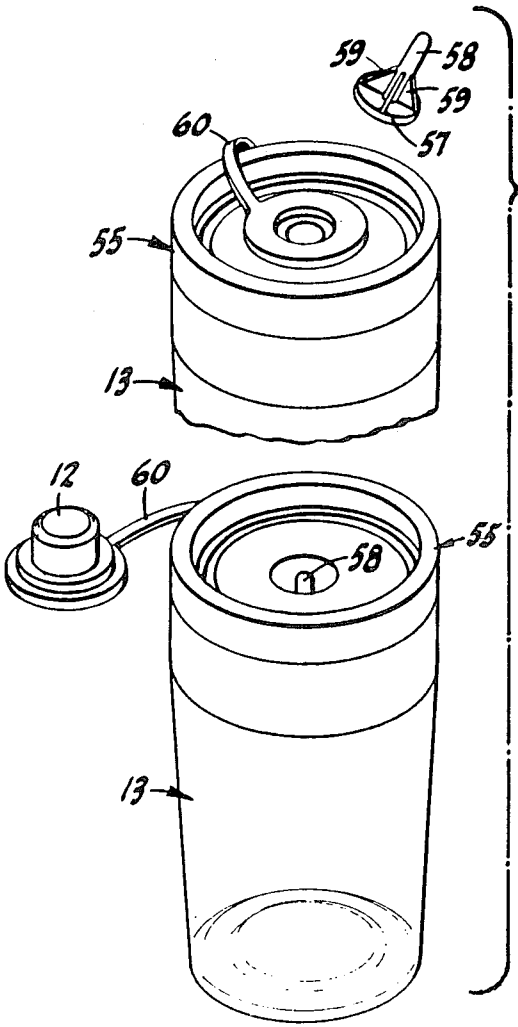
FIGS. 5 and 6 are, respectively, a perspective view and a vertical cross-section of an alternative embodiment of the closure or cover which is depicted in FIGS. 1–4.
Figure 6:
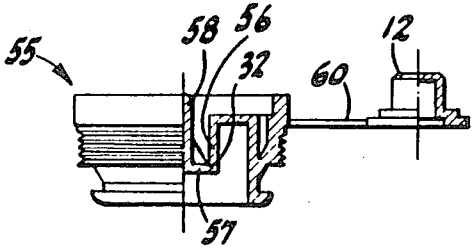

FIGS. 5 and 6 depict another alternative enclosure 55 which incorporates a recessed spout 56 having a break-away seal 57. Like tab 31, FIG. 1, seal 57 preferably has a parting line 32 to facilitate removal. A rod 58 is integrally formed to the seal and supported by a number of integral ribs 59-59. The rod 58 is twisted back and forth a few times to break the seal along the parting line 32 so that the seal assembly can be removed. As shown in FIGS. 5 and 6, plug 12 can be attached or formed integrally with a strap 60 which, in turn, is attached or formed integrally with the closure 55. Quite obviously, this prevents losing or misplacing the plug 12 and also facilitates use of the plug.

SUMMARY OF USE OF THE CONTAINER 10

Figure 7:
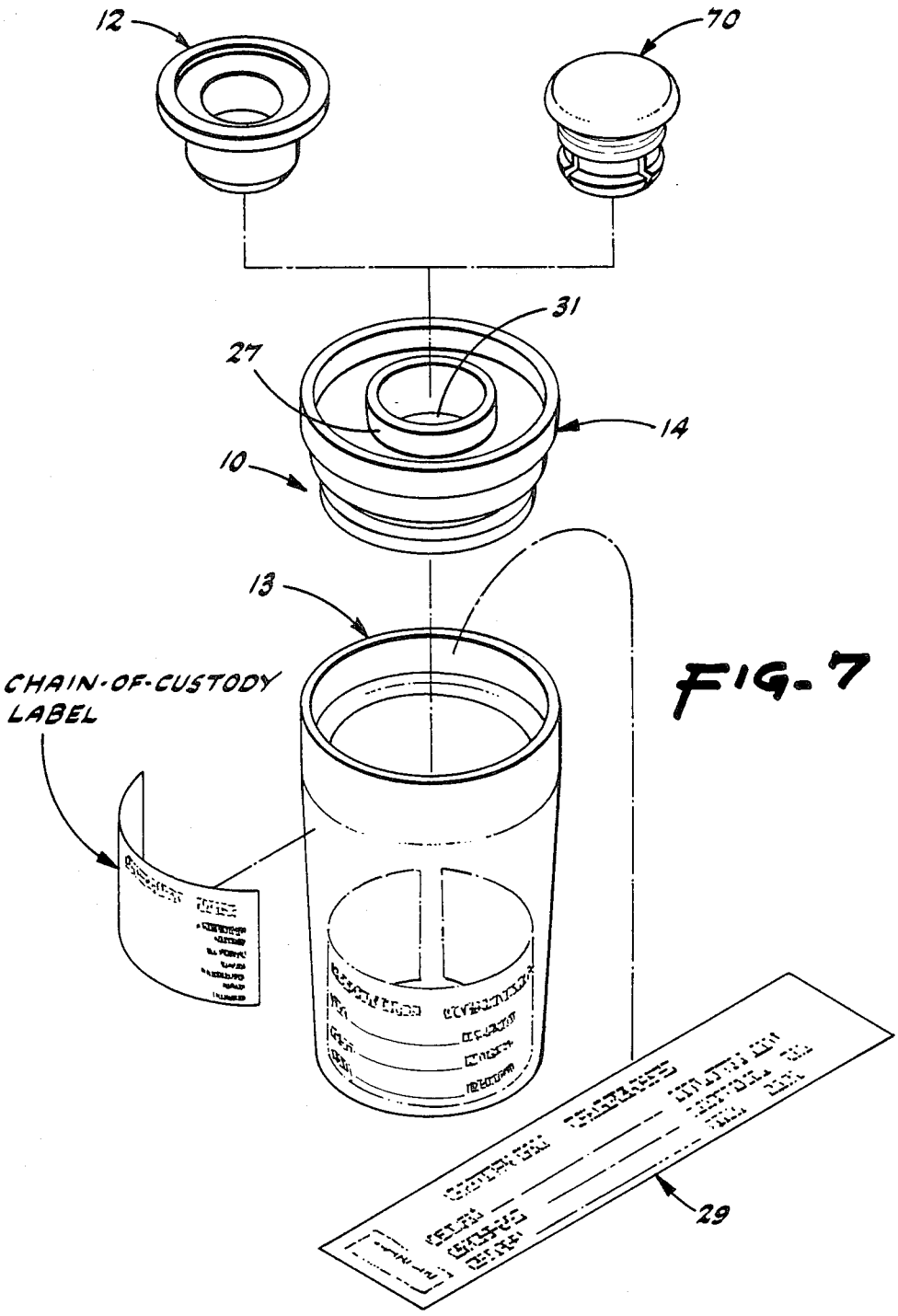
FIG. 7 is an exploded perspective view of the container assembly of the present invention, showing the relationship of the various components including the alternative removable plug and locking plug.

Referring in particular to FIG. 7, to illustrate the use of the container 10 for the storage, transport and analysis of a liquid specimen such as urine, initially at a providing site (such as a doctor's office or lab) an attendant (such as a nurse or doctor) fills out an identification label 29 which identifies the individual who provides the sample, the date, recipient, etc., and inserts the label into the cup 13. Preferably, the identification label is waterproof and is impervious to other liquids as well. Also, the label may contain a unique sequential serial number and/or a bar code for reading by optical scanning instruments and automatic computer data input. The patient or subject then fills the cup 13 with urine, the cap or closure 14 is inserted into the cup 13 and locked and sealed, and the resulting locked, sealed container assembly 10 may be transported or transferred to a lab for analysis.

The bottle 10 arrives at the lab intact, with the specimen and the identification label intact: the hard, smoothly profiled, locked, bottle 10 is essentially impregnable so that the integrity of the bottle 10 and the seal 31, FIGS. 2 and 3, are relatively immune to destruction or tampering and, thus, the contents of the container assembly including the specimen and label are also safe from tampering. In addition, any breaching of the container would leave detectable, physical evidence. Furthermore, as discussed above, the container material is designed to facilitate use and locking of the container and at the same time to leave physical evidence in the form of a hole if a needle or other sharp objects are inserted through the container. Thus, the lab or other recipient is assure by the lack of evidence of physical tampering that no tampering has taken place, that the identification information such as the name and time on the label 29 have not been altered since sealing and, of course, that the specimen itself has not been tampered with.

In addition, temperature sensitive indicia such as temperature recording labels available from Wahl Instruments, Inc., Culver City, Calif., can be incorporated onto the label to monitor the temperature, for example to ensure, the temperature of the as-deposited sample is within the normal human body temperature range. For example, two dots of such material which permanently change colors at different temperatures such as 90° and 105° F., ensure that the deposited sample is either too cold (in which case, the sample may not have come directly from the subject, may have been diluted with tap water, etc.) nor too hot (the liquid was heated).

At the lab, a lab technician removes the seal tab 31, FIGS. 2 and 3, draws out the sample using a pipette or simply by pouring, for testing, then seals the container with the removable plug 12. Depending upon the results of the analysis or other criteria, the container is discarded or stored. If storage is required for lengthy periods, for example for preservation during legal proceedings, the container can be stacked and refrigerated or frozen without damage to the container.

Figure 8:
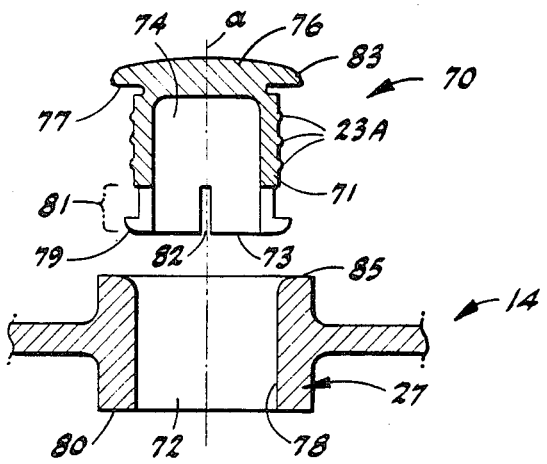
FIG. 8 is an exploded cross-sectional view illustrating the lockable plug before insertion into the closure's spout.
Figure 9:
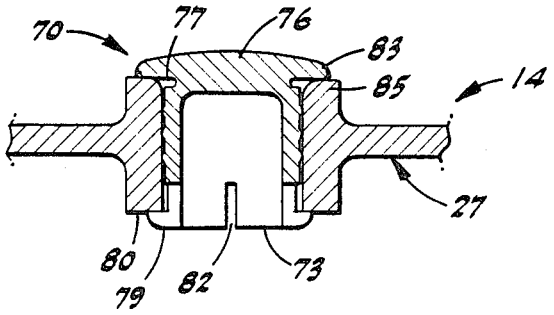
FIG. 9 is a cross-sectional view showing the lockable plug after insertion into and locking engagement with the closure's spout and FIG. 10 depicts an alternative to the type of container assembly shown in FIG. 7, the cup, cover, spout and plug of which are of oval cross-section.

Referring to FIGS. 7–9, there is shown an alternative to plug 12, in the form of a locking replaceable plug 70. Relocking plug 70 incorporates locking and sealing functions which are similar to those of closure 14. As shown in FIG. 7 and in particular in FIG. 8, plug 70 comprises a body 71 of selected cross-sectional size and configuration for providing a close sliding fit within hole 72 of the spout 27. The bottom end 73 of the body 71 is open, while the top end 74 thereof has formed thereon an integral cap 76. A circumferential parting line 77 having reduced thickness relative to the neck or body 71 is formed beneath the cap to facilitate opening the plug 70 by removing the cap 76 using a knife or other sharp instrument. A plurality of sealing rings or ribs 23A-23A are formed about the outer periphery of the body to provide a waterproof seal with the inside surface 78 of the spout hole in the manner of ribs 23-23, FIG. 3. A circular hook or lip 79 is formed at the bottom of the plug body 71 for irreversibly engaging the circular bottom surface 80 of the spout body 27.

Also, the bottom section or skirt 81 of the plug body 71 has a plurality of axial slots 82, i.e., the slots extend generally parallel to the axis, a, and length of the illustrated cylindrical plug and spout. Slots 82-82 allow the bottom section 81 of the spout body 71 to flex inwardly so that the hook engages and slides down the hole 72 during insertion of the plug. When the plug reaches the bottom end 72 of the plug, the resilient plug material causes the bottom section 81 to flex outwardly so that the circular hook 79 irreversibly engages the bottom end 80 of the spout. Also, the cap 76 includes a lip or flange 83 which extends radially past the plug body 71 for engaging the top end 85 of the spout. The length of the plug body 71 and the distance between the lip 83 and the hook 79 are approximately equal to the length of the spout 27 so that, upon the hook reaching and engaging the bottom end 80 of the spout 27, lip 83 prevents further axial movement and irreversibly locks the hook 79 onto the spout. In effect, the hook 79 and the lip 83 cooperate to prevent movement of the plug in either direction upon insertion, thus locking the plug 70 in place.

The relocked and resealed container 10 can only be reopened by cutting along the circumferential parting line 77 to remove the cap. Once the cap 76 is cutaway, however, the contents of the container are accessible. To remove plug 70 and relock the container, the portion of the plug remaining in the closure spout is simply pushed downwardly into the cup 13, readying the closure to receive another locking plug 70. The number of plug bodies 71 inside the cup 13 indicates the number of times the container 10 has been opened since the original opening removal of tab 31.

Alternatively, where a liquid sealing capability is unnecessary, for example, where the container is used for a solid material such as tablets or granular materials, the rib seals 23-23 may be omitted from the closure 14. The materials such as aspirin or prescription tablets can be inserted into the vial or cup 13 at the point of manufacture or prescription and the closure 15 affixed at that time. Then, when the container is received by the consumer or end user, that person is ensured that the vial and contents have not been tampered by the fact that a bottle is intact and the seal 31 unbroken. In this case, the customer or end user removes the seal 31 and replaces the seal with the plug 12.

Figure 10:
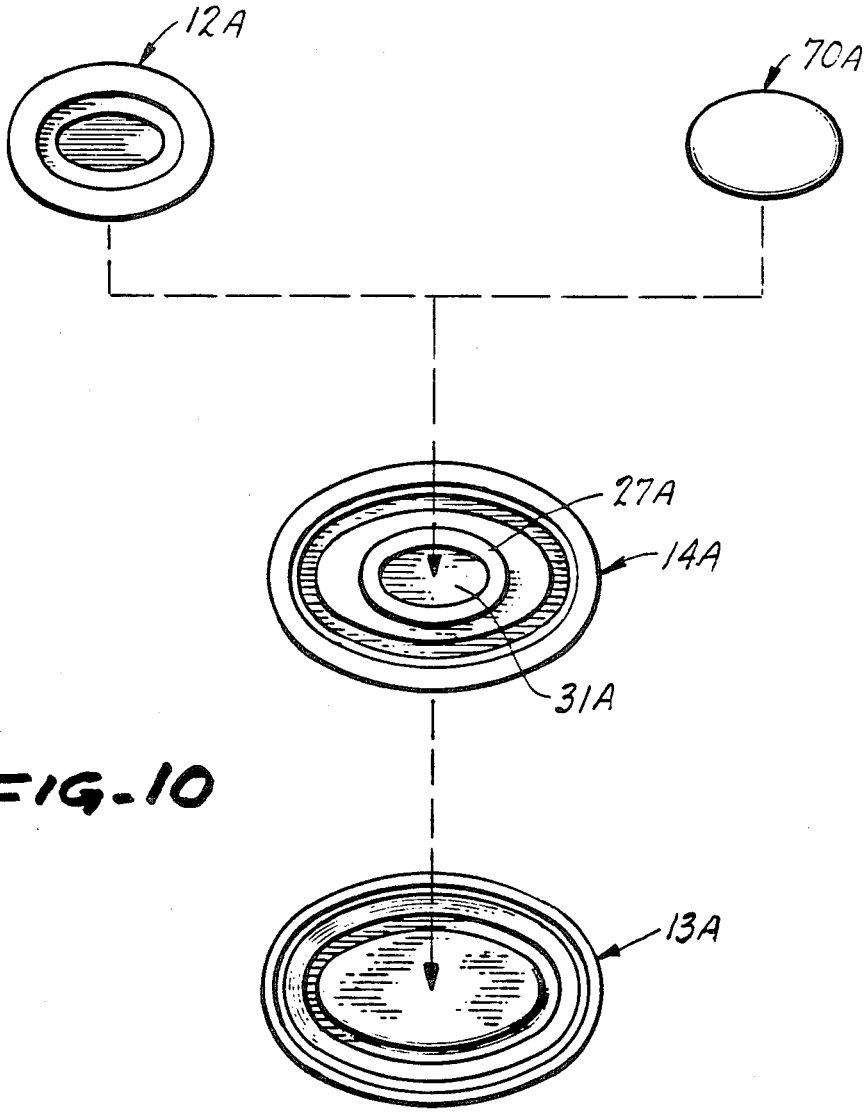

It should be emphasized that the present container, spout and plug are not limited to, a particular horizontal cross-section. Thus, while FIGS. 1,2, 5, and 7 depict a generally circular cross-section and associated cylindrical container, cap, spout, and plugs, other configurations will be readily implemented to accommodate particular uses. For example, it may be useful to use a circular configuration when the containers are used for urine samples collected from males and oval configuration for females. FIG. 10 depicts an alternative embodiment of the container assembly shown in FIG. 7, in which components such as the plug 12A or 70A, cup 13A, enclosure 14A and spout 27A are oval. Quite obviously, individual components such as the cup and any mating components such as closure could be a particular cross-sectional configuration such as circular or ovular and other components could be a different cross-sectional configuration. More generally, substantially any cross-section is feasible since our container assembly is not of the screw-on or rotary-type favored in the prior art. The variety of possible shapes is limited only by the possible consideration that with certain materials it may be desirable to eliminate sharp corners to preserve maximum waterproof sealing.

In short, our container is characterized by a unique combination of highly tamper resistant construction and high visibility tamper evident construction.

Summary of Certain Advantages

The following is a partial listing of the advantageous features of our container over conventional products and systems widely used for collecting, e.g., urine samples for drug screens:

1. Materials

The materials of the container are injection molded of tough, clear, virgin butadiene-styrene and natural, high density polyethylene.

2. Leak-Proof Sealing Ring

When the closure is pressed into the pre-filled clear plastic cup, the plurality of separate "O"-ring-like rib seals create a positive liquid-tight seal inside the cup which cannot be broken without obvious physical damage to the container. Conventional containers use screw caps which depend on an individual to tighten to prevent leakage. These types of screw caps can come loose while in transit to a laboratory causing a mess and loss of sample specimen.

3. Irreversible Positive-Locking Closure

When the closure is pressed into the cup, an audible "snap" is heard when the closure locks itself in place. Once locked, the contents cannot be adulterated, removed or added to without an obvious hole or physical damage to the container. Other, more conventional specimen containers may have their caps unscrewed, opened and resealed with "tamper-evident" tapes, and no one would know that the same had been violated.

4. Tamper-Proof Identification Label

Our container assembly includes a pre-marked, waterproof label inside of the container before a specimen is ever collected. The label has provisions, e.g., for the name or initials of the subject, the person collecting the sample, the doctor, the facility, the date and time of day the sample was collected and a serial number. After the specimen is collected and the closure is locked in place, the identification information on the label is preserved until the container is destroyed. Conventional specimen container labels can be changed, replaced or adulterated because the labels are accessible outside of the closed container.

5. Optional Sequential Serial Number on Label

For additional security, pre-printed identification labels with one-of-a-kind sequential serial numbers can be used. In addition, the sequential numbers can be implemented in "bar code" form for optical scanning instruments to automatically input specimen data to computer systems. These sequentially numbered labels would be difficult to forge or duplicate.

6. Optional Permanent Temperature Sensors

For a positive permanent record of the temperature of the urine sample collected, miniature, waterproof temperature indicating sensors may be included as an option on the label inside of the container. Current urine specimen containers have no provision for recording the temperature of the collected sample to ensure that the specimen was body temperature and not just a sample of "toilet water" or someone else's substitute urine.

7. Laboratory Access with Special Tool

Our container assembly is designed to be totally sealed and secure from point of collection to laboratory, thus helping to assure the integrity of the sample and the "chain-of-custody". The laboratory technician opens the sealed container with a custom hand tool or any small pointed pen knife to draw the sample for testing.

8. Convenient Pourable and Resealable Spout

Once the laboratory technician has opened the container, a sample may be removed with a transfer pipette or it may be poured from the central spout on the closure. After sampling, a plug is used to reseal the container for storage. The removable plug may be used or alternatively, and preferably, the special locking plug may be used.

9. Stackable - For Minimum Storage Space

Positive drug screens usually require storage of the sample for up to six months for future evaluation. Our containers may be stacked vertically so as to occupy a minimum amount of storage space.

10. May be Frozen

Our container assembly may be frozen with urine specimens inside for long-term storage without damage to the containers.

Having thus described a preferred and alternative embodiments, what is claimed is:

1. Joinable components for a tamper resistant, tamper evident container, comprising:

a cup of hard, relatively rigid material comprising an annular sidewall and having a closed bottom end and an open upper end, said cup having inwardly extending peripheral first lip means formed about the upper inner surface thereof;

a cover of size and configuration for insertion into the open end of the cup, said cover comprising a hard, relatively flexible, annular sidewall and having outwardly extending, peripheral second lip means formed about the outer surface thereof, the relative flexibility of said cover permitting insertion of the second lip means into the cup to engage said first lip means and, in combination with the relative rigidity of said cup and first lip means, providing secure locking engagement of the first and second lip means, and said cover further comprising an integral tubular spout having top and bottom ends and a sealing member across the spout; and a lockable plug for the spout comprising an open tubular body of size and configuration adapted for sliding insertion into the spout, said body having a cap formed on the upper end thereof, peripheral third lip means extending laterally from said upper end and peripheral fourth lip means extending laterally from the bottom thereof, said plug lip means being spaced apart a selected distance for locking the plug onto the top and bottom ends of the spout.

2. The joinable components for a tamper resistant, tamper evident container of claim 1, said plug including longitudinal slots at the bottom end thereof for permitting the plug body to flex inwardly to facilitate insertion into the spout.

3. The joinable components for a tamper resistant, tamper evident container of claim 1, wherein the cup and cover are of cylindrical cross-sectional configuration.

4. The joinable components for a tamper resistant, tamper evident container of claim 1, wherein the spout and plug are of cylindrical cross-sectional configuration.

5. The joinable components for a tamper resistant, tamper evident container of claim 1, wherein the cup and cover are of oval cross-sectional configuration.

6. The joinable components for a tamper resistant, tamper evident container of claim 1, wherein the spout and plug are of oval cross-sectional configuration.

7. The joinable components for a tamper resistant, tamper evident container of claim 1, wherein the cup is molded from impact resistant rigid material selected from butadiene-styrene and polycarbonate injection molding resin, and the cap, spout and plug are molded from low density polyethylene.

8. The joinable components for a tamper resistant, tamper evident container of claim 1, the tubular spout having a sealing member there across closing the spout said spout also including a circumferential parting line of reduced thickness relative to the adjacent thickness of said spout, for facilitating removal of said sealing member to open the spout.

9. The joinable components for a tamper resistant, tamper evident container of claim 1, further comprising a liquid-proof identification lable of size and configuration for being placed inside the cup.

10. The joinable components for a tamper resistant, tamper evident container of claim 9, said label having temperature sensitive indicia adapted for changing color at selected temperatures.

11. The joinable components for a tamper resistant, tamper evident container of claim 1, further comprising a flexible annulus joined integrally to and spaced laterally outwardly from the cover sidewall and having at least one rib formed in the outer surface thereof size for sealing against the inside of the cup sidewall.

12. Joinable components for tamper resistant, tamper evident container, comprising:

a cup of hard, relative rigid material comprising an annular sidewall and having a closed lower end and an open upper end, said cup having inwardly extending peripheral first lip means formed about the upper inner surface thereof;

a cover of size and configuration for insertion into the open end of the cup, said cover comprising a hard, relatively flexible annular sidewall and having outwardly extending, peripheral second lip means formed about the outer surface thereof, the relative flexibility of said cover permitting insertion of the second lip mans into the cup to engage said first lip means and, in combination with the relative rigidity of said cup, providing secure locking engagement of the first and second lip mans, and said cover further comprising an integral tubular spout and having a sealing member across the spout; and a lockable plug for the spout comprising and open tubular body having an upper and lower end, said plug being of size and configuration adapted for sliding insertion into the spout and said body having a cap formed on the upper end thereof; peripheral third lip means extending laterally from the upper end of the plug and peripheral fourth lip means extending laterally from the lower end thereof, said plug lip means being spaced apart a selected distance for locking the plug onto the upper and lower ends of the spout; the plug including a circumferential parting line of reduced thickness relative to the adjacent thickness of the plug, for facilitating removal of the cap; and the cover further comprising a flexible annulus joined integrally to and spaced laterally outwardly from the cover sidewall and having at least one rib formed in the outer surface thereof of size for sealing against the inside of the cup sidewall.

* * * * *